United States Patent [19]

Schmitz, Jr. et al.

[11] 4,039,093

[45] Aug. 2, 1977

[54] BOOM ARM SUPPORT LOCK

[75] Inventors: Floyd Albert Schmitz, Jr.; Wayne Gerald Smith, both of Burlington, Iowa

[73] Assignee: J. I. Case Company, Racine, Wis.

[21] Appl. No.: 718,940

[22] Filed: Aug. 30, 1976

[51] Int. Cl.[2] ..... B66C 23/00

[52] U.S. Cl. ..... 214/130 R; 92/23; 212/8 R; 214/776

[58] Field of Search ..... 92/17, 23, 25, 27; 214/776, 140; 187/8.47; 172/466, 481; 298/17 B; 212/59 A, 8 R, 61-65; 188/67; 254/139.1

[56] References Cited

U.S. PATENT DOCUMENTS

| | | | |
|---|---|---|---|
| 1,558,636 | 10/1925 | Rutan | 212/61 |
| 2,969,885 | 1/1961 | Lutz | 280/763 |
| 3,091,346 | 5/1963 | Yawn | 212/63 |
| 3,152,789 | 10/1964 | Bartholomew | 254/139.1 |
| 3,360,146 | 12/1967 | Borer et al. | 214/776 |
| 3,918,601 | 11/1975 | Zimmerman | 214/776 |
| 3,982,648 | 9/1976 | Luedtke et al. | 92/23 |

*Primary Examiner*—Lawrence J. Oresky
*Attorney, Agent, or Firm*—Arthur J. Hansmann

[57] ABSTRACT

A boom arm safety lock including a pivotally-mounted boom arm and a fluid cylinder assembly for pivoting the arm up and down. A lock bar is pivotally mounted adjacent the boom arm for upwardly supporting the boom arm in the event the fluid in the cylinder assembly is exhausted, and the boom arm will therefore remain in the raised position.

1 Claim, 4 Drawing Figures

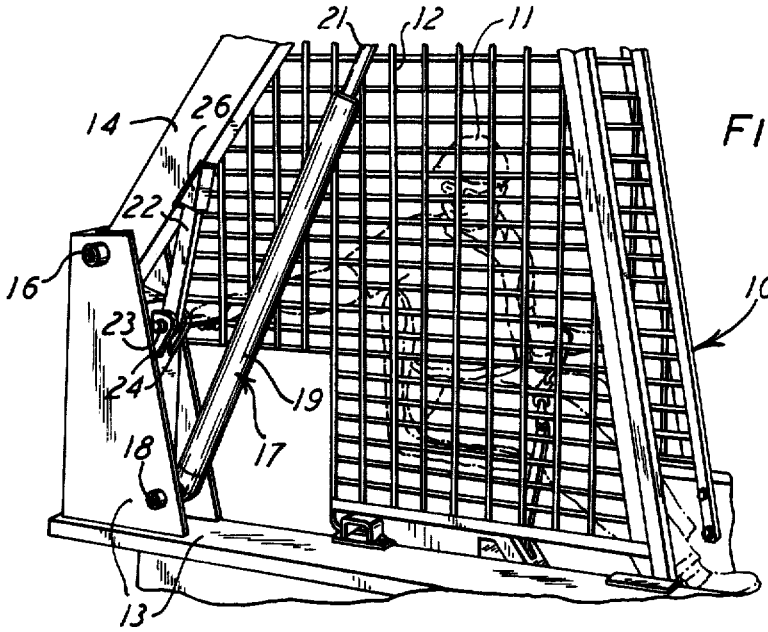
FIG. 1
FIG. 2
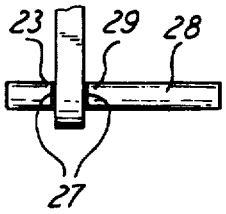
FIG. 3
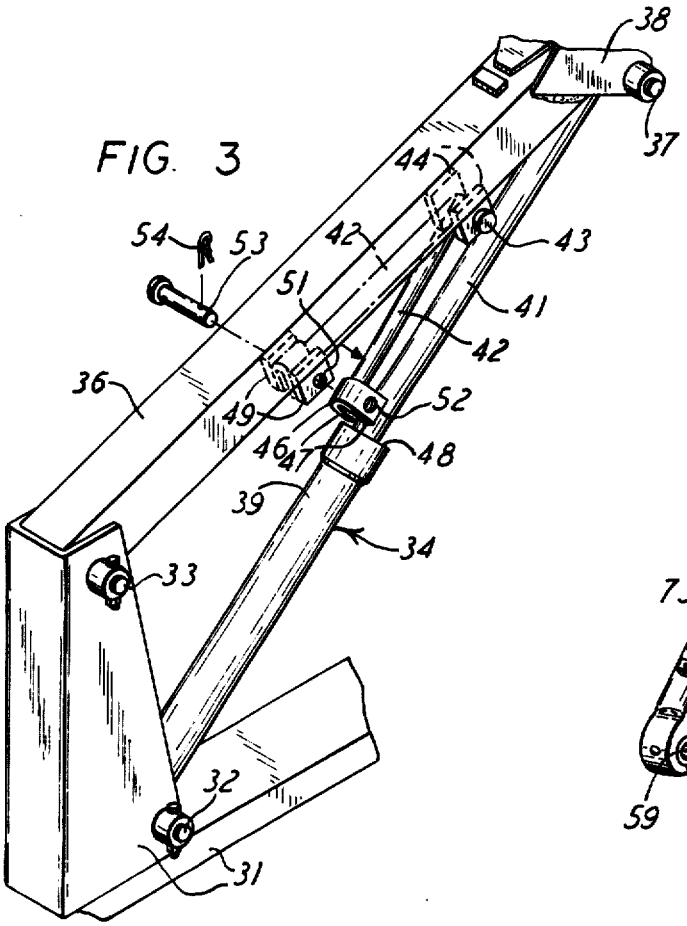
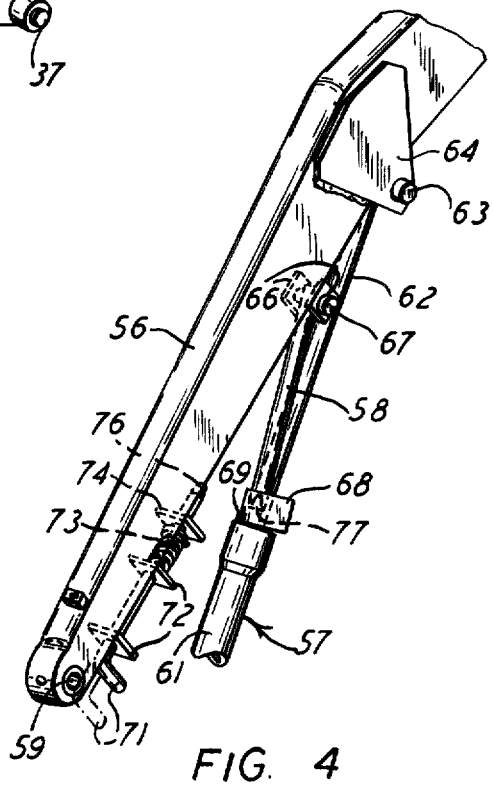
FIG. 4

BOOM ARM SUPPORT LOCK

This invention relates to a boom arm safety lock, and, more particularly, it relates to a safety lock for upwardly supporting a pivotally mounted boom arm which is normally under the influence of a cylinder assembly.

BACKGROUND OF THE INVENTION

The prior art is already aware of various arrangements of supports or safety devices for upwardly supporting pivotal members, such as vehicle lifts and other types of lifting and hoisting member. Examples of prior art supports, utilized in connection with fluid power, such as fluid cylinder assemblies, are found in U.S. Pat. Nos. 2,550,764 and 3,223,251 and 3,317,004 and 3,330,381. These prior art devices show utilization of a pivotally mounted support member which can be positioned between two abutment surfaces when a fluid cylinder assembly has been extended, and thus the support member retains the extended position even though the fluid is exhausted in the cylinder assembly.

However, the present invention relates to a boom arm safety lock wherein the arrangement is made for upwardly supporting a boom arm, such as one which is utilized on a tractor and has a material-handling bucket or the like on the extending end of the arm. In these instances, it is significant that the apparatus is arranged so that a support member or lock bar can be readily and easily positioned in a safe and supportive position for the boom arm when the arm is in the upwardly pivoted position. Further, in this arrangement, support member or lock bar is under the control of the operator who is normally seated on a tractor or the like and can reach the support member or lock bar to position it in its supporting position, and the arrangement is such that the support member or lock bar will also be retained in an inoperative position and will not interfere with the normal operation of the boom arm and cylinder assembly, and the support member or lock bar need not be maneuvered unless and until the supported position is desired. Accordingly, the present invention provides a boom arm safety lock which is simplified in its structure and arrangement and which is completely reliable for supporting the weighty boom and which is readily accessible to the operator for positioning in the operative position and also for retracting the support member from the operative position and placing it into a secured inoperative position.

In considering the foregoing, it will also be understood that the tractor and the boom arm commonly require that the boom arm be left in a raised position while the operator removes himself from the location of the controls for the fluid cylinder assembly and the like, and at that time the operator may be required to inspect the work area or service the boom arm in the way of greasing or checking hose connections or the like. At those times, it is important that the boom arm be in a safe position and secured in that raised position so that there will be no personal injury or property damage. As such, the present invention provides an arrangement for a support member or lock bar which actually positions itself in the securing mode, at least once the operator has released the lock bar so that it is available for securing the boom arm in the raised position.

Other objects and advantages will become apparent upon reading the following description in light of the accompanying drawings.

BRIEF DESCRIPTION OF THE DRAWINGS

FIG. 1 is a perspective view of a fragment of a tractor and a boom arm incorporating one embodiment of this invention.

FIG. 2 is a front elevational view of a fragment of the apparatus shown in FIG. 1.

FIGS. 3 and 4 are perspective views of fragments of boom arms and cylinder assemblies and showing two other embodiments of support members utilized therewith.

DETAILED DESCRIPTION OF THE PREFERRED EMBODIMENTS

FIG. 1 shows a fragment of a tractor or a lifting installation, generally designated 10, and it shows an operator 11 in a seated position within a protective cage 12. The tractor 10 has its usual frame members 13, and the usual pivotally mounted boom arm 14 is shown pivoted on the frame 13 by means of a pivot pin 16 which is on a horizontal plane and thus has a horizontally disposed pivot axis. The usual fluid cylinder assembly 17 is also shown, and it is mounted on a horizontally disposed pivot pin 18 which also has a horizontal pivot axis, and the assembly 17 is disposed directly beneath the boom 14 and in the vertical plane thereof. Further, the assembly 17 includes the cylinder 19 and the extending piston rod 21 which extends upwardly and would connect to an upper but unshown portion of the boom 14, in a conventional arrangement and as shown and will be described in connection with FIGS. 3 and 4.

It will therefore be seen and understood in all of the embodiments that the cylinder assembly is arranged to expand and contract and is pivotally mounted and is connected to the respective boom arm for pivoting the boom arm in the vertical plane and to thus raise and lower the extending end of the boom arm which may have a material-carrying bucket or the like thereon. Of course it is significant that the boom arm be retained in the raised position at certain times, and thus the presence of fluid in the assembly 17, or the effectiveness of the fluid cylinder assembly 17, cannot be fully relied upon to retain the boom arm 14 in the upwardly pivoted or raised position. Accordingly, the safety lock bar of this invention is provided in combination with the cylinder assembly and the pivotally mounted boom arm.

Therefore, a lock bar or support member 22 is pivotally mounted directly beneath the boom arm 14 and is on a rotatably mounted shaft 23 which is supported in two spaced-apart ears or supports 24 suitably affixed to the frame pieces 13. Also, a block member 26 is affixed to the underside of the boom arm 14, such as by welding thereto as shown. With this arrangement, the lock bar 22 can be positioned as shown in FIG. 1 to abut the block 27 and to be retained with the pin 23, all to thereby upwardly support the boom 14 and prevent the boom 14 from pivoting downwardly from the position shown in FIG. 1.

In this arrangement, the pin 23 is suitably connected to the lock bar 22 itself, such as by welding at 27 as shown in FIG. 2, and the pin 23 includes a handle portion 28 which extends toward the operator 11 and is thus available for rotation by the operator 11, as shown in FIG. 1. Also, the pin 23 includes the portion connected with the lock bar 22 itself, and this is the portion designated 29, and thus the pin 23 is arranged to support the lock bar 22 and to present the handle 28 to the operator. As such, the lock bar 22 forms a triangle with the boom arm 14 and the intervening support frame members 13, all as shown in FIG. 1, and the same is true of the arrangement in FIGS. 3 and 4. Further, the ears 24, along with the shaft 23, secure the lower end of the lock bar 22 in its operative position shown in FIG. 1; and the block 26 provides an abutment means against which the upper surface of the lock bar 22, in the FIG. 1 position, is shown to be engaged in the FIG. 1 position. As such, the length of the lock bar 22 from the shaft 23 to the undersurface of the block 26 is equal to that distance between the shaft 23 and the undersurface of the block 26 when the boom arm 14 is in the desired raised position.

FIGS. 3 and 4 show two other embodiments of the invention, and here it will be noted that the support or tractor has frame pieces 31 which support pivot pins 32 and 33 which are horizontally disposed and are in the same vertical alignment so that the pin 32 is below the pin 33. The cylinder assembly 34 is pivotally mounted on the pin 32, and the boom arm 36 is pivotally mounted on the pin 33, and the assembly 34 and boom arm 36 are also secured together by a pin 37 which is supported on the extending end of the arm 36 by means of plates 38 welded to the arm 36, as shown. The assembly 34 includes the usual cylinder 39 and rod 41, and extension and contraction of the assembly 34 will cause the up and down pivotal action of the boom arm 36 about its pivot pin 33, all in the usual manner.

FIG. 3 further shows the lock bar or member 42 which is pivoted to the underside of the boom arm 36 on the pivot pin 43 secured to the arm 36 by means of two spaced-apart ears 44 which can be welded or otherwise attached to the boom arm 36 to extend therebelow, as shown in FIG. 3. The lock bar 42 extends from the pivot pin 43, and a U-shaped clevis 46 is affixed to the extending end of the lock 42. The clevis 46 has spaced-apart legs 47 which are spaced apart a distance slightly greater than the diameter of the piston rod 41 but less than the span or diameter of the end 48 of the cylinder 39. Accordingly, the clevis 46 can straddle the rod 41 and it will abut the cylinder end surface 48. As such, the lock bar 42 holds the boom arm 26 in the upwardly pivoted position, and the cylinder 39 and lock bar 42 form one rigid member extending between the pins 32 and 43, to thus provide the upward support for the boom arm 36, as mentioned. Also, it will be seen and understood that the engagement of the clevis 46 with the cylinder assembly 34, as explained above, is automatic and effected only by the weight itself of the lock bar 42 which will cause the lock bar to fall downwardly onto the rod 41 when the lock bar 42 is released.

FIG. 3 further shows that two spaced-apart ears 49 are suitably affixed to the undersurface of the boom arm 36, such as by welding or the like, and the ears 49 have aligned holes 51 extending therethrough, and the clevis 46 also has aligned holes 52 extending therethrough, that is one hole 52 in each of the clevis legs 47, and the holes 51 and 52 align with each other when the lock bar 42 is pivoted upwardly to its inoperative or store position shown by the dot-dash lines in FIG. 3. A securing pin 53 extends through the holes 51 and 52, when the lock bar 42 is in the dot-dash position shown, and then the pin 53 secures the lock bar 42 in that stored or inoperative position, and a retaining pin 54 secures the pin 53 in the retaining position.

Therefore, when the operator releases the pin 53 by withdrawing it from the holes 51 and 52, the lock bar 42 is free to fall onto the rod 41 and thus present a rigid strut with the cylinder 39 and thereby provide the rigid support for the raised boom arm 36.

FIG. 4 shows the arrangement of a boom arm 55 and a cylinder assembly 57 and a lock bar 58. The boom arm 56 can be pivotally mounted about its pivot axis defined by the hole 59 in the boom arm 56, and of course the lower end of the cylinder 61 of the assembly 57 would also be pivotally mounted, as in FIGS. 1 and 3, and the piston rod 62 of the assembly 57 is pivotally attached by the pin 63 to the plates 64 secured to the boom arm 56, as shown in FIG. 54. Also similar to the showing and description of FIG. 3, the boom arm 56 has the spaced-apart ears 66 affixed thereto and supporting a pivot pin 67 which pivotally connects with the one end of the lock bar 58. Likewise, a clevis 68 is affixed to the other end of the lock bar 58, and the clevis straddles the piston rod 62 and abuts the end surface 69 of the cylinder 61, as described in connection with FIG. 3 also. Again, the engagement of the lock bar or lock support member 58 with the cylinder assembly 57, that is by having the clevis 68 straddle the piston rod 62 and abut the cylinder end surface 69, is automatically accomplished when the lock bar 58 is free to fall onto the cylinder assembly 57.

A retaining pin 71 is movably supported on the underside of the boom arm 56, by slidably passing through two plates 72 affixed to the undersurface of the boom arm 56, such as by welding. A compression spring 72 is disposed between one of the plates 72 and a plate 74 affixed to the pin 71 to move therewith, and thus thhe spring 73 urges the end 76 of the pin 71 upwardly, as viewed in FIG. 4, and therefore the pin 71 will engage the end of the lock bar 58, or at least will move to within the confines of the clevis 68, to thereby secure the lock bar 58 in the inoperative or raised position comparable to the dot-dash position shown in FIG. 3 for the lock bar 42. Further, the end of the lock bar 58 may be provided with a pocket 77 which is of a size to receive the pin end 76 when the pin 71 has been withdrawn to its dot-dash position shown and when the lock bar 58 is swung upwardly to the mentioned inoperative position and when the pin 71 is then released to move to its full line position to where the lock bar 58 is retained in the inoperative and stored position.

Accordingly, the three embodiments show an arrangement for forming a triangle relative to the respective boom arm and the frame or support between the pivots for the boom arm and the cylinder assemblies, respectively. Further, FIGS. 3 and 4 show the pin member 37 and 63 for receiving the upward support force of the lock bar 42 and 58, respectively. Cylinder surfaces 48 and 69 present abutment means to the lock bar for securing the lock bar in the supporting position mentioned. As such, release or exhaustion or any failure of the fluid in the respective fluid cylinder assemblies 34 and 57 will not affect the upward support of the respective boom arm 36 and 56, just as explained in connection with FIG. 1.

What is claimed is:

1. A boom arm safety lock comprising a boom arm pivotally mounted for up and down pivotal movement and extending in a direction away from the pivot axis thereof, a fluid cylinder assembly pivotally mounted on a pivot axis below the first-mentioned said pivot axis and having a cylinder and an extendable rod, said cylinder assembly being pivotally connected with said boom arm for inducing the up and down pivotal movement of said boom arm in response to respective extension and contraction of said cylinder assembly, a lock bar pivotally mounted at one end on said boom arm for pivotal movement in a vertical plane beneath said boom arm to positions parallel with and forming an angle with said boom arm for then upwardly supporting said boom arm, a V-shaped, downwardly open clevis disposed at the other end of said lock bar and being of a size to span said rod and abut said cylinder and thereby be in the position of retaining said cylinder assembly extended for supporting said boom arm and secure sand lock bar in the supporting position to thereby retain said boom arm pivoted upwardly irrespective of the supporting force of said cylinder assembly, said lock bar other end having a pin opening therein and within the confines of said clevis and axially aligned with the length of said lock bar, a retaining pin slidably mounted on the underside of said boom arm and being located thereon to align longitudinally with and be partly received in said pin opening when said lock bar is pivoted parallel to said boom arm for releasably securing said other end of said lock bar to said boom arm, and a spring operative on said pin for urging said pin into said clevis and said pin opening the shape of the pin and the pin opening being the same for the pin opening to receive the pin.

* * * * *